US009205900B2

(12) United States Patent
Tatum

(10) Patent No.: US 9,205,900 B2
(45) Date of Patent: Dec. 8, 2015

(54) HARNESS ASSEMBLY HAVING A DEPLOYABLE INFLATABLE LIFE RAFT ATTACHED THERETO

(71) Applicant: Donnie Franklin Tatum, Jupiter, FL (US)

(72) Inventor: Donnie Franklin Tatum, Jupiter, FL (US)

( * ) Notice: Subject to any disclaimer, the term of this patent is extended or adjusted under 35 U.S.C. 154(b) by 0 days.

(21) Appl. No.: 14/201,754

(22) Filed: Mar. 7, 2014

(65) Prior Publication Data

US 2014/0256199 A1 Sep. 11, 2014

Related U.S. Application Data

(60) Provisional application No. 61/774,675, filed on Mar. 8, 2013.

(51) Int. Cl.

| | |
|---|---|
| ***B63C 9/04*** | (2006.01) |
| ***B63C 9/26*** | (2006.01) |
| ***B63C 9/15*** | (2006.01) |
| *B63C 9/00* | (2006.01) |

(52) U.S. Cl.

CPC . *B63C 9/04* (2013.01); *B63C 9/155* (2013.01); *B63C 2009/007* (2013.01); *B63C 2009/042* (2013.01)

(58) Field of Classification Search

CPC ..... B63C 9/04
USPC ..... 441/88
See application file for complete search history.

(56) References Cited

U.S. PATENT DOCUMENTS

| | | | | |
|---|---|---|---|---|
| 2,114,301 | A * | 4/1938 | Harrigan | 244/148 |
| 4,645,465 | A * | 2/1987 | Courtney | 441/40 |
| 5,297,978 | A * | 3/1994 | Ramsey | 441/131 |
| 5,468,167 | A * | 11/1995 | Givens | 441/40 |
| 5,516,233 | A * | 5/1996 | Courtney | 405/186 |
| 5,692,450 | A * | 12/1997 | Alter et al. | 114/61.24 |
| 5,855,454 | A * | 1/1999 | Courtney et al. | 405/186 |
| 6,164,237 | A * | 12/2000 | Coryell et al. | 114/345 |
| 6,659,689 | B1 * | 12/2003 | Courtney et al. | 405/186 |
| 7,018,257 | B2 * | 3/2006 | Courtney | 441/93 |
| 2004/0002270 | A1 * | 1/2004 | Courtney | 441/40 |
| 2004/0157514 | A1 * | 8/2004 | Courtney | 441/88 |
| 2014/0256199 | A1 * | 9/2014 | Tatum | 441/84 |

* cited by examiner

*Primary Examiner* — S. Joseph Morano
*Assistant Examiner* — Jovon Hayes
(74) *Attorney, Agent, or Firm* — McHale & Slavin P.A.

(57) ABSTRACT

A harness assembly having a pouch attached thereto for storage of a manually deployable life raft. The harness assembly is comprised of a waist strap of sufficient length to reach around the mid-section of a human body and a back, frontal left, and frontal right panel sections integrally joined with one another forming a life vest. The frontal left and right panel sections include a fastener for coupling together to form a neck opening. The pouch is removably attached to the harness assembly and positioned thereinbetween the waist strap and life vest. The inflatable life raft is disposed of within the pouch in a deflated state. The life raft includes an elongated tether cord having a first end attached to the life vest and a second end attached to the life raft. The life raft is adapted to be inflated when, in an emergency situation, the raft is removed from the pouch.

12 Claims, 5 Drawing Sheets

HARNESS ASSEMBLY HAVING A DEPLOYABLE INFLATABLE LIFE RAFT ATTACHED THERETO

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/774,675, entitled "LIFE VEST HAVING A DEPLOYABLE INFLATABLE LIFE RAFT ATTACHED THERETO", filed Mar. 8, 2013. The contents of the above referenced application is incorporated herein by reference.

FIELD OF THE INVENTION

This invention relates generally to the field of maritime rescue devices and, in particular, to a harness assembly having a pouch attached thereto for storage of a compressed inflatable individual life raft that is deployable in an emergency.

BACKGROUND OF THE INVENTION

A personal flotation device (often referred to as PFD, but also known as a life saver, life jacket, life preserver, Mae West, life vest, cork jacket, buoyancy aid or flotation suit) is a device designed to assist the wearer to keep afloat when, for any unanticipated reason, he/she ends up in the water. Life vests are designed to keep a wearer's head above water and help him/her remain in a position that permits proper breathing. Life vests are known to have saved lives in a variety of situations; for example, when a boat capsized in rough water, when a boat sank in unexpectedly heavy seas, when a boater was accidentally thrown from a boat as a result of excessive wave action or a collision, and when a wearer was unable to swim as his/her clothing became waterlogged.

Life vests are made in a variety of forms and sizes to accommodate body sizes of wearers and variances in body weight. Designs will vary depending upon the circumstances the boater may encounter, and on the convenience preferred for various levels of protection. However, all life jackets must conform to standards required by a number of agencies: The U.S. Coast Guard, ISO/CEN (International Organization for Standards/European Committee for Standardization), IMO/SOLAS (International Maritime Organization/Safety of Life at Sea), and a variety of federal and state regulations. The U.S. Coast Guard mandates that life vests be U.S.C.G. approved, in good and serviceable condition, and the appropriate size for the intended user. Life vests must be supplied on commercial seafaring vessels, military vessels, pleasure crafts and carried on airplanes that travel over water.

Life vests often feature either a singular air chamber or a pair of sealed air chambers constructed of coated nylon with a protective outer encasing of heavier, tougher material such as vinyl. These air chamber vests are commonly referred to as inflatable life jackets or life vests. They are available in a variety of styles and generally more comfortable and less bulky to store or wear than the traditional foam vests, and therefore provide advantages of being compact, light-weight, easily stored and transported when in a deflated state, and less expensive to purchase.

The air chambers within inflatable life vests are located over the breast, across the shoulders and encircling the back. They may be inflated by either self-contained means such as carbon dioxide cartridges activated by pulling of a cord, or manual blow tubes with a one-way valve for inflation by exhalation of the wearer. Some inflatable life vests include a self triggering inflation device which reacts to salt/fresh water or responds to water pressure when submerged, thereby causing the inflatable life vest to inflate. Regardless of whether a manual pull cord or automatic trigger is used, a pin punctures the cartridge/canister and the carbon dioxide gas escapes into the sealed air chamber, causing the life vest to inflate and keep the wearer afloat.

Drifting in open seas and international waters, as would be encountered by survivors of accidents experienced on long commercial or pleasure sea voyages, commercial airliners and even military carriers, requires measures to assist survival when experiencing extreme conditions like, perhaps, extended periods in the water. Life vests have, therefore, been lined with pockets and attachment points for distress signals and survival aids such as: a handheld two-way radio, emergency beacon, signal mirror, sea marker dye, smoke or light signal flare, strobe light, first-aid supplies, concentrated nutritional items, water purification supplies, shark repellent, knife, or pistol.

However, the ocean is vast, and complications can arise. For example, a person wearing a life vest can drift for days before he/she is rescued. Often times the life vest is just not enough. A life vest is a singular flotation device designed to keep the wearer held in an upright position. However, it will not keep the wearer, whether in good physical condition or injured when entering the water, from eventually experiencing fatigue or possible hypothermia after long term exposure to wind driven waves or cold water temperatures. The life vest does not offer the luxury of keeping the wearer completely out of the water and away from the elements associated therewith, as would be provided by a life raft.

A life raft is a piece of safety equipment used to provide emergency transport for people to get away from an endangered or sinking vessel. A life raft is also designed to provide reasonable shelter that, hopefully, will protect the occupants until they are found and rescued. It is also recommended, or in many cases required, that a life raft be placed on board boats, larger yachts and ships of varying sizes. An inflatable life raft, as the name suggests, is a form of a life raft which can be folded and stored when not in use, and then inflated at the time of an emergency. Similar to life vests, inflatable life rafts are made from a durable material able to withstand rapid inflation and the effects of exposure to water. The self contained automatic inflation system can be activated with a pull tab enabling the raft to be inflated easily and quickly. Life rafts are capable of being stored in a partially or totally collapsed state, in contrast to life boats which are of a solid construction and used primarily with large ocean going vessels.

In emergency situations, where there may only be one life boat or raft available to a plurality of people, many individuals are left without the benefit thereof, and thus with only a life vest as a means of survival. It would be beneficial for the individual in the water to also have a life raft to provide adequate shelter and mode of transit while he/she awaits rescue. Thus, what is lacking in the art is a one person life raft that is securable to a person in a similar fashion to a life vest and is manually or automatically deployed.

SUMMARY OF THE INVENTION

A harness assembly having a pouch attached thereto for storage of a manually deployable personal life raft is disclosed. The harness assembly is comprised of a waist strap of sufficient length to reach around the mid-section of a human body, a back portion, a frontal left panel section, and a frontal right panel section integrally joined with one another to form a life vest. The frontal left and right panel sections include a fastener for coupling together to form a neck opening. The flexible pouch is removably attached to the harness assembly and positioned thereinbetween the waist strap and the life vest. The inflatable life raft is disposed of within the pouch in a deflated state. The life raft includes an elongated tether cord having a first end attached to the harness assembly and a second end attached to the life raft so the inflated life raft does not drift far away from the person wearing the harness assembly. The life raft is adapted to be inflated, manually or triggered, when the raft is removed from the pouch in an emergency situation.

Accordingly, it is a primary objective of the instant invention to provide a deflated life raft disposed within a pouch attached to a harness assembly. The inflatable life raft is adapted to be inflated, manually or triggered, when the raft is removed from the pouch in an emergency to maximize a wearer's chance of survival when lost at sea.

It is also an objective of the instant invention to provide yet another means of protection for the wearer, namely a personal life raft compressed and contained within a pouch attached to the harness assembly which can be activated by the wearer in a simple, safe and timely fashion. The life raft is stored in a rolled deflated stated that unrolls away from the wearer when activated for inflation so as to prevent injury to the wearer.

It is another objective of the instant invention to provide a life vest that is inflatable, manually or triggered, whereby a pin punctures a cartridge/canister and the carbon dioxide gas escapes into the sealed air chamber, causing the life vest to inflate to keep the wearer afloat. Additionally, the life vest can be provided with a manual inflation valve. The one way inflation valve includes a pivoting stem, mouth piece, and a deflator valve (within the inflation valve) for releasing air from the air chambers within the life vest. The manual inflation valve is to be used in a situation whereby the canister inflation means is not operational or fails.

It is a further objective of the instant invention to provide a better mode of transit via a life raft that provides shelter to at least partially protect a drifter from harsh elements.

It is yet a further objective of the instant invention to provide a deployable inflatable life raft fabricated from a resilient material such as thermoplastic, vinyl, canvas, neoprene, or any combination thereof.

It is a still further objective of the instant invention to include a tether cord having one end attached to the life vest and the second end attached to the life raft, so the inflated life raft does not drift far away from the person wearing the vest.

It is an additional objective of the instant invention to provide an inflatable deployable life raft having a plurality of flexible reflectors and handles disposed on the top surface thereof. Additionally, the life raft may include a boarding ladder constructed of a webbing bridle and a brightly colored canopy to assist sea or air rescue efforts to locate the drifter.

It is a further objective of the instant invention to provide an inflatable deployable life raft lined with attachment points for survival aids such as a rain water purification system.

It is yet a further objective of the instant invention to provide a dragging implement attached to the deployed inflated life raft so as to create drag to prevent the life raft from following the ocean currents.

It is yet an additional objective of the instant invention to provide at least one self-contained carbon dioxide cartridge within the life raft that is activated by the pulling of a release cord. The manual release cord has a first end attached to the life raft and a second end exposed outside of the pouch. Upon pulling the release cord, the cord activates a pin that punctures the cartridge/canister and carbon dioxide gas escapes into the sealed air chamber within the life raft. The release cord is accessible from outside of the pouch for immediate accessibility by the user in an emergency. Furthermore, the pull cord inflates the life raft away from the wearer to avoid injury to the wearer. Additionally, the life raft is provided with a manual inflation valve. The one way inflation valve includes a pivoting stem, mouth piece, and a deflator valve (within the inflation valve) for releasing air from the air channels within the raft. The manual inflation valve is to be used in a situation whereby the canister inflation means is found not to be operational.

It is yet another objective of the instant invention to provide a separable pouch containing a compressed inflatable deployable individual life raft that can be attached to any variety of life vests.

It is yet a further objective of the instant invention to provide a separable pouch containing a compressed inflatable deployable individual life raft that need not be tethered to a life vest. The separable pouch containing a compressed inflatable deployable individual life raft can be used in conjunction with a belt and tethered thereto.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
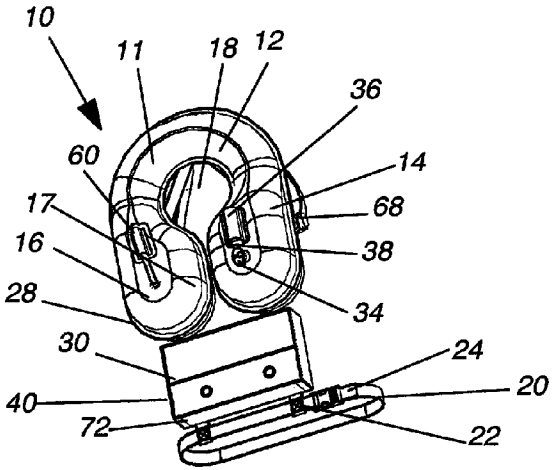
FIG. 1 is a front perspective view of the harness assembly of the instant invention.
Figures 2, 6:
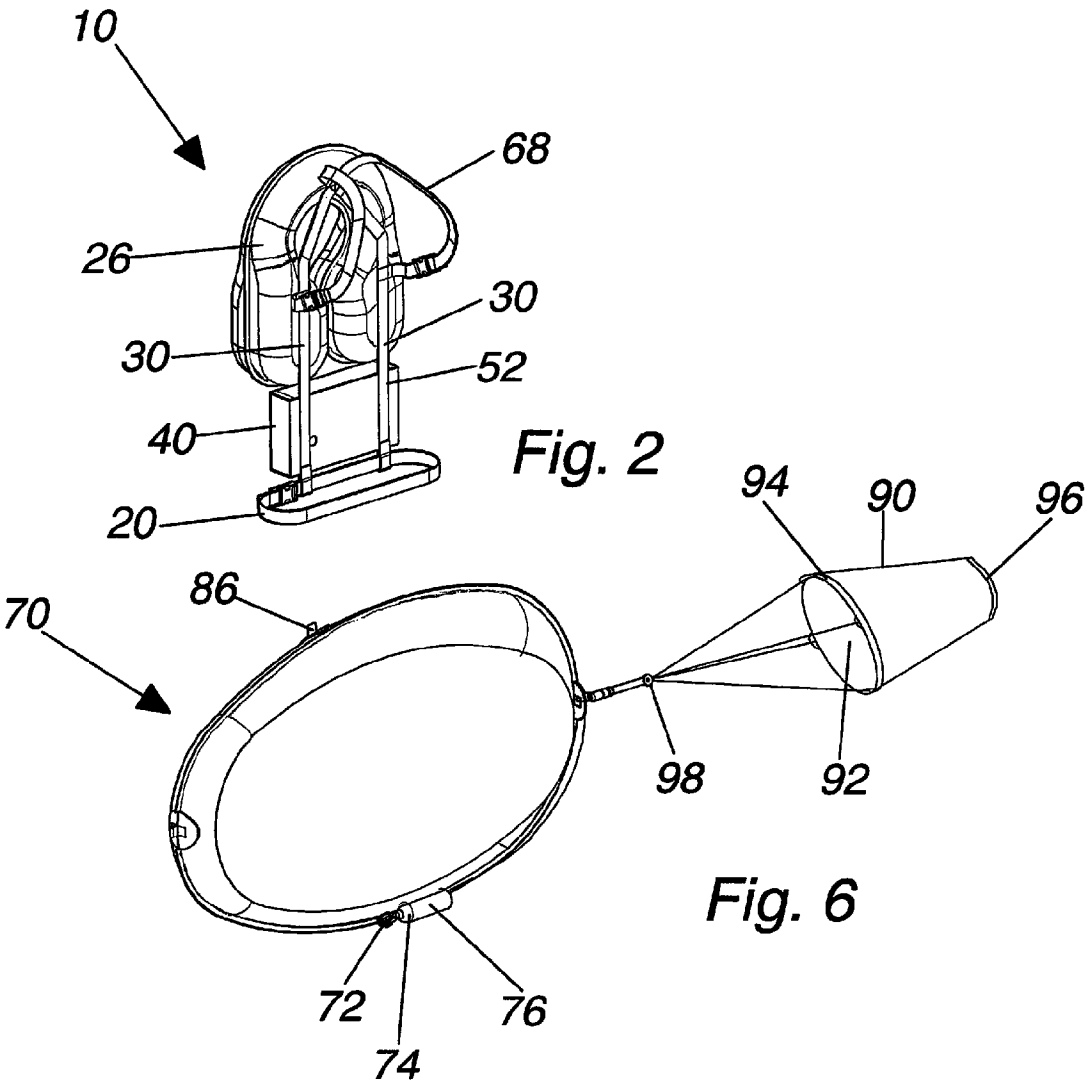
FIG. 2 is a back perspective view of the harness assembly of the instant invention.
FIG. 6 is a bottom perspective view of the deployable life raft of the instant invention.
Figure 4:
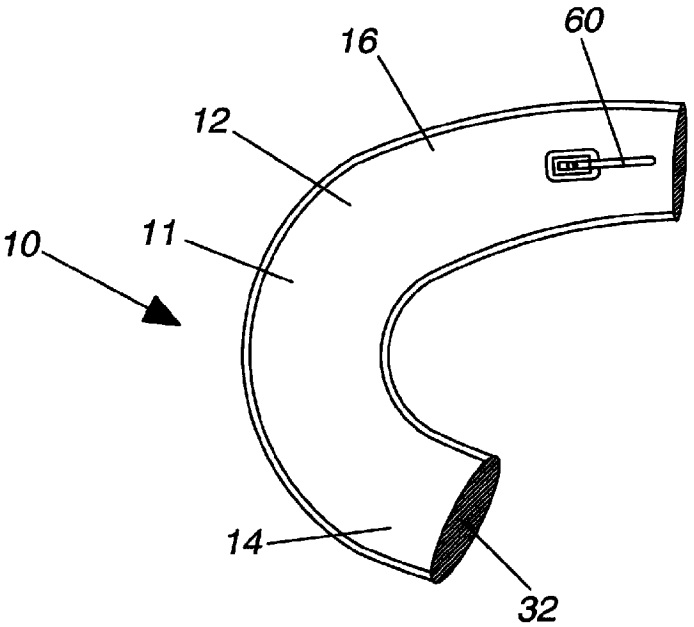
FIG. 4 is a cross-sectional view of the harness assembly of the instant invention.

The instant invention is comprised of a harness assembly 10 having a pouch 40 attached thereto for storage of a manually deployable personal life raft 70. As shown in FIGS. 1 and 2, the harness assembly 10 is comprised of a waist strap 20 of sufficient length to reach around the mid-section of a human body, a back portion 12, a frontal left panel section 14, and a frontal right panel section 16 integrally formed with one another forming a life vest 11, and runner straps 30 that attach the waist strap 20 to the life vest 11. The frontal left and right panel sections, 14 and 16, include a fastener 17 for coupling thereof to form a neck opening 18. There are a variety of fasteners used in the art for the coupling of the frontal left and right panel sections, 14 and 16, such as the use of a hook and loop fastener, snap buttons, or a zipper which runs along the interior edge portions of the frontal left and right panel sections, not shown. The backside 26 of each frontal left and right panel sections, 14 and 16, includes a runner strap 30 that extends below the bottom edge 28 of the frontal left and right panel sections, 14 and 16. The runner straps 30 are attached to the backside 26 of the frontal sections, 14 and 16, on one end and the opposite end is attached to the waist strap 20. Positioned thereinbetween the waist strap 20 and the bottom edge 28 of the frontal left and right panel sections, 14 and 16, is a flexible pouch 40. The waist strap 20 is of a sufficient length to reach around the mid-section of a human body and is adjustable to allow for varying sizes of wearers. The waist strap 20 has a first end terminating in an outlet slot 22 and a second end terminating in an inlet retainer 24. Additionally, the harness assembly may be provided with a pair of shoulder straps 68 for use by over the shoulders of the wearer. It is contemplated that the harness assembly 10, including the waist strap 20, shoulder straps 68, tether cord 54, runner straps 30, and pouch 40, is constructed from a resilient material of a thermoplastic material, vinyl, canvas, neoprene, or any combination thereof. As shown in FIG. 4, the life vest 11 is provided with air chambers 32 within the back portion 12, frontal left panel 14, and frontal right panel 16 which are in fluid communication with each other.

As shown in FIGS. 1 and 2, the life vest 11 may be inflated by a pin 34 which punctures a cartridge/canister 36, whereby carbon dioxide gas escapes into the sealed air chamber 32, causing the life vest 11 to inflate and keep the wearer afloat. The puncturing of the canister 36 can occur manually by a pull cord 38 or triggered by an event, such as upon occurrence of submergence. The life vest 11 can also be provided with a manual inflation valve 60. The one way manual inflation valve 60 includes a pivoting stem 62, mouth piece 64, and a deflator valve 66 (within the inflation valve, not shown) for releasing air from the air chambers 32 within the vest 11. The manual inflation valve 60 is to be used in a situation where the triggered or manual inflation means is not operational.

Figure 8:
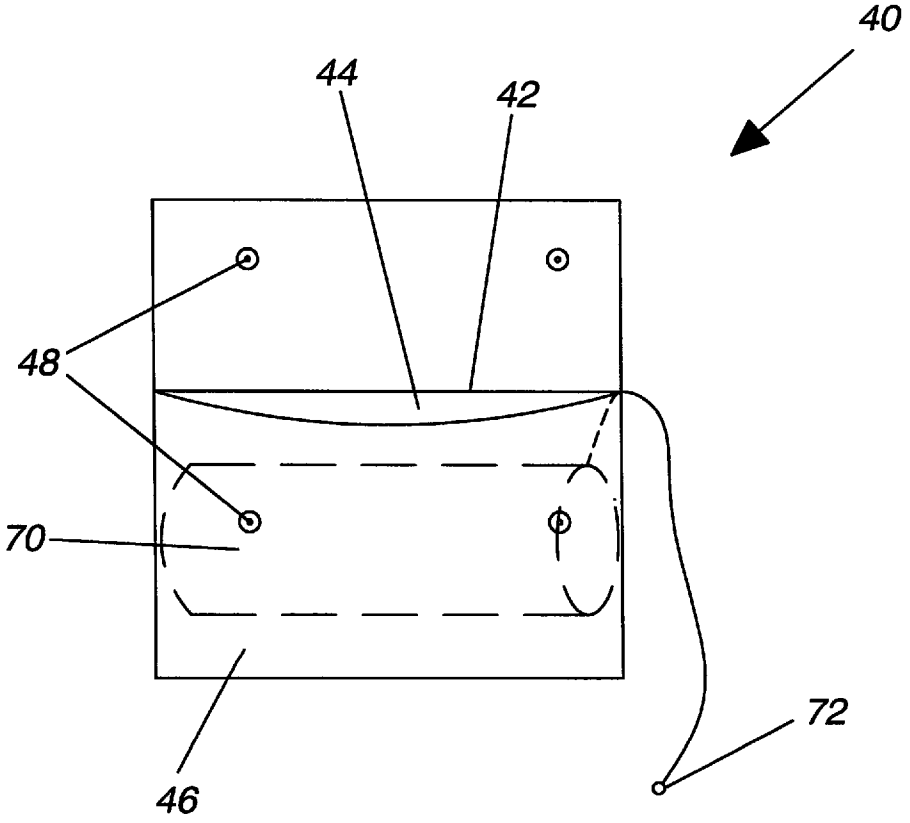
FIG. 8 is a front view of the flexible pouch of the instant invention.

As shown in FIGS. 1 and 2, the flexible pouch 40, is removably attached to the harness assembly 10, specifically the runner straps 30. The runner straps 30 are attached to the backside 26 of the frontal sections, 14 and 16, on one end and to the waist strap 20 on the opposite end. Positioned thereinbetween the waist strap 20 and the bottom edge 28 of the frontal left and right panel sections, 14 and 16, is the flexible pouch 40. In the preferred embodiment, the pouch 40 is positioned between the life vest 11 and the waist strap 20 and attached to the runner straps 30. The pouch 40 can be attached to the runner straps 30 using hook and loop fasteners 52, clips, or the like. As shown in FIG. 8, the flexible pouch has an interior compartment 42 and a pouch opening 44 into the interior compartment 42. The pouch opening 44 can be secured in a closed position at the front side 46 of the pouch 40 using a hoop and loop fastener 48. The pouch opening 44 should have a closure means of sufficient strength to remain closed when not in use, yet not prevent the life raft from coming out of the pouch as it inflates. In an alternative embodiment, not shown, it is contemplated that the pouch 40 need not be attached to the harness assembly 10. The pouch 40 can be separable from the harness assembly 10 and carried in hand by the user, or used without the harness assembly 10 in emergency situations. Additionally, the flexible pouch 40 may contain a belt inlet opening on the backside thereof sized to accommodate a belt which is not apart of the harness assembly, not shown.

Figure 3:
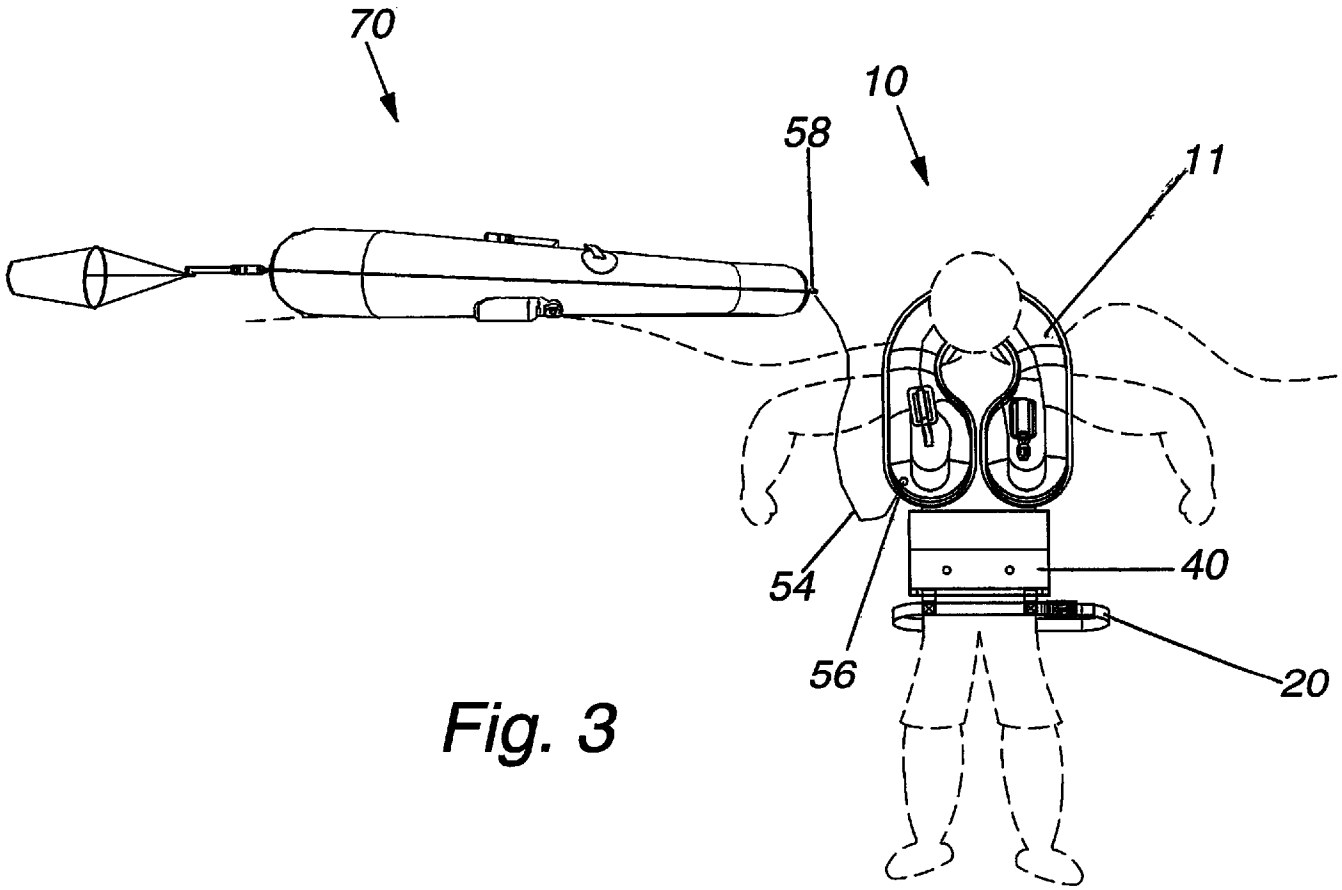
FIG. 3 is a pictorial representation of the harness assembly tethered to the deployed life raft of the instant invention.

The inflatable life raft 70 is disposed within the pouch 40 in a deflated state. The deflated life raft 70 is stored so that, when activated to be inflated, it inflates away from the wearer to avoid injury to the wearer. Specifically, the life raft 70 is stored in a rolled deflated state and unrolls away from the wearer when activated for inflation. As shown in FIG. 3, an elongated tether cord 54, having a first end 56 attached to the harness assembly 10 and a second end 58 attached to the life raft 70, enables the wearer to retain contact with and control of the raft 70 during inflation or afterwards. Upon inflation of the life raft 70, the life raft 70 removes itself from the pouch 40 and completes inflation while floating. Without the use of the tether cord 54, it is possible that the life raft 70 could drift away from the wearer. The tether cord 54 is of a length suitable for the user to be able to sit within the inflated life raft 70 while wearing the harness assembly 10 and move about the life raft 70 freely without the tether cord 54 impeding movement of the user, and even maintain contact with the raft 70 if expelled during violent weather.

In the alternative embodiment, the separable pouch 40 containing a compressed inflatable deployable individual life raft 70 can be used in conjunction with a belt or any other article of clothing on the drifter, not shown. The separable pouch 40 would be tethered to the drifter using the tether cord 54. The separable pouch 40 containing a life raft 70 within would be tethered to a belt or other article of clothing. The life raft 70 is adapted to be inflated, manually or triggered, when the raft 70 is removed from the pouch 40 in an emergency situation so as not to depart from the scope of the invention. The tether cord 54 should be constructed to fit about a variety of articles on a user, for instance a belt, belt buckle, belt loop, around the waist or other body part, or the like, using fasteners.

Figure 5:
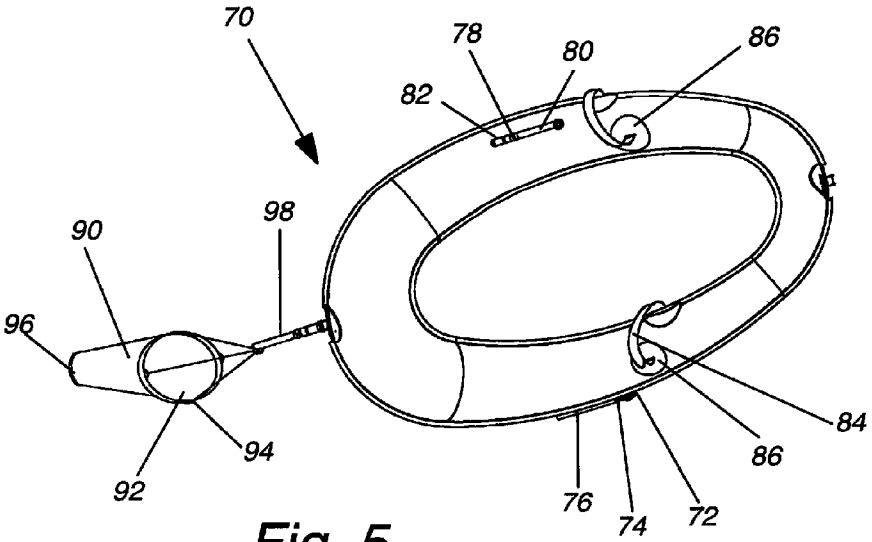
FIG. 5 is a top perspective view of the deployed life raft of the instant invention.
Figure 7:
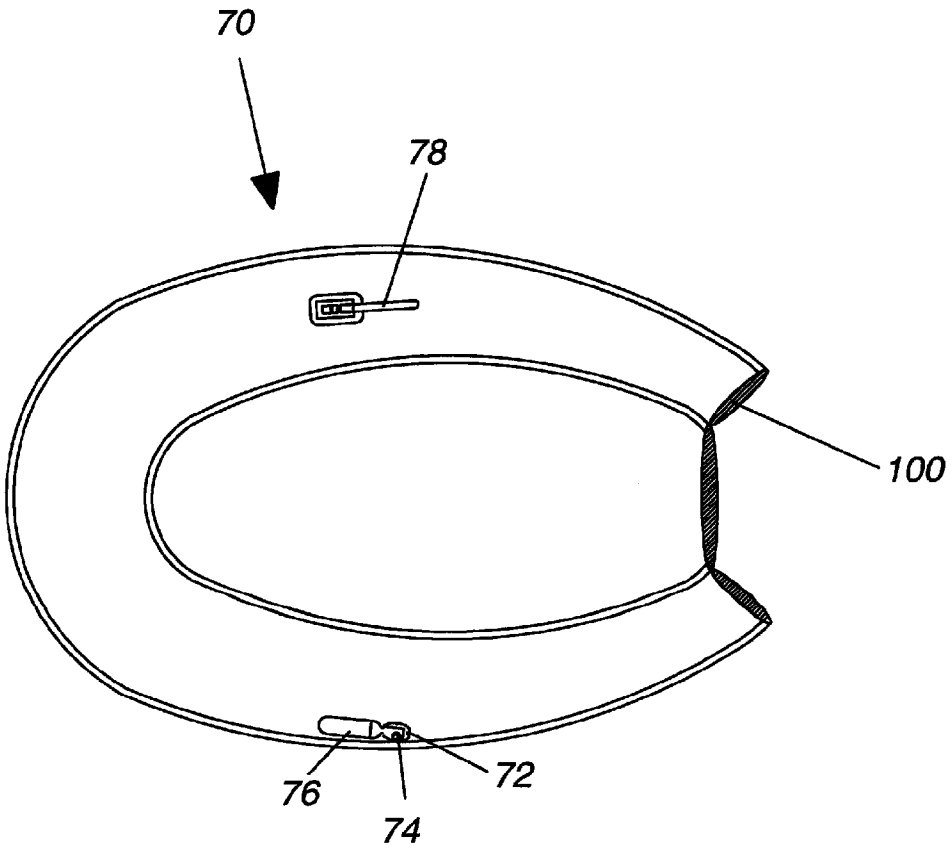
FIG. 7 is a cross-sectional view of the life raft of the instant invention.

As shown in FIGS. 5 and 6, the life raft 70 is adapted to be inflated, manually or triggered, when the raft 70 is removed from the pouch 40 in an emergency situation. The deployable inflatable life raft 70 is fabricated from a resilient material of a thermoplastic material, vinyl, canvas, neoprene, or any combination thereof. In the preferred embodiment, the life raft 70 is deployed from the pouch 40 by the pulling of a release cord 72, which activates a pin 74 that punctures the cartridge/canister 76, specifically shown in FIG. 8. The pin 74 punctures the cartridge/canister 76 and allows carbon dioxide gas to escape into the sealed air channels 100 within the life raft 70, shown in FIG. 7. The release cord 72 is accessible from outside of the pouch 40 for immediate use by the user in an emergency, more specifically shown in FIG. 1. As shown in FIGS. 5 and 6, the life raft 70 is also provided with a manual inflation valve 78. The one way inflation valve 78 includes a pivoting stem 80 and mouth piece 82. Not shown, the inflation valve may also include a deflator valve for releasing air from the air channels within the raft. The manual inflation valve 78 is to be used in a situation whereby the triggered inflation means is not operational.

The inflatable deployable life raft 70 includes a plurality of reflectors 86 and handles 84 disposed on the top surface thereof, shown in FIGS. 5 and 6. The life raft 70 is also provided with a dragging implement 90 attached thereto, or sea anchor as known in the art, so as to create drag to help prevent the life raft 70 from following the ocean currents. The dragging implement 90 is a hollow body 92, having a conical shape. The hollow body 92 allows water to pass therethrough from a larger open end 94 to a smaller open end 96. The dragging implement 90 is attached to the life raft 70 using a drag line 98. Additionally, the life raft 70 may include a brightly colored canopy to assist sea or air rescue efforts to locate the drifter, a boarding ladder constructed of a webbing bridle, and/or a rain water purification system, not shown.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A wearable life raft harness comprising:

a harness assembly constructed and arranged to be secured to a human body, said harness assembly including a waist strap having sufficient length to reach around a mid-section of said human body;

a flexible pouch removably attached to said harness assembly and having an interior compartment and a top opening;

an inflatable life raft disposed within said interior compartment of said pouch, said inflatable raft in a deflated state within said interior compartment, whereby said raft is adapted to be inflated when removed from said interior compartment, said raft including a canister filled with a sufficient quantity of pressurized gas to inflate said raft, a release cord having a first end attached to said life raft and a second end exposed from said pouch so that pulling said release cord releases said raft from said interior compartment and triggers inflation of said life raft by causing a pin to puncture said canister, said raft having a first end and a second end one of said ends being constructed to contain a larger volume of said pressurized gas than the other; and an elongated tether cord having a first end attached to said life raft and a second end attached to said harness.

2. The wearable life raft harness of claim 1, wherein said harness assembly includes a back portion, a frontal left panel section, and frontal right panel section integrally joined with one another, said frontal left panel section and said frontal right panel section including a fastener for coupling each together and forming a neck opening.

3. The wearable life raft harness of claim 2, wherein said back portion, said frontal left panel section, and said frontal right panel section are comprised of air chambers in fluid communication with one another.

4. The wearable life raft harness of claim 3, wherein said air chambers are inflatable.

5. The wearable life raft harness of claim 2, wherein said waist strap is attached to a bottom end of said frontal left panel section and said frontal right panel section.

6. The wearable life raft harness of claim 5, wherein said pouch is positioned thereinbetween said bottom end of said frontal left and right panel sections and said waist band.

7. The wearable life raft harness of claim 1, wherein said life raft includes a plurality of flexible reflectors and handles.

8. The wearable life raft harness of claim 1, wherein said life raft includes a dragging implement attached thereto, whereby said dragging implement is deployed when said raft is in an inflated state to prevent said raft from following ocean currents.

9. The wearable life raft harness of claim 1, wherein said harness assembly and said life raft is fabricated from a resilient water-resistant material.

10. The wearable life raft harness of claim 1, wherein said pouch is separable from said harness assembly to be hand carried.

11. The wearable life raft harness of claim 1, wherein pulling said release cord causes said canister to release carbon dioxide within said life raft.

12. The wearable life raft harness of claim 11, wherein said life raft includes a manual one way inflation valve, said manual one way inflation valve is comprised of a pivoting stem and a mouth piece, whereby said life raft can be manually inflated when removed from said pouch.

* * * * *